United States Patent [19]

Tanaka et al.

[11] 4,228,811

[45] Oct. 21, 1980

[54] APPARATUS FOR CONTROLLING A COIN SORTING MACHINE

[75] Inventors: Akio Tanaka; Yoshihisa Nakajima; Shinji Yokomori, all of Kawasaki, Japan

[73] Assignee: Fuji Electric Co., Ltd., Kanagawa, Japan

[21] Appl. No.: 913,275

[22] Filed: Jun. 7, 1978

[30] Foreign Application Priority Data

Jun. 7, 1977 [JP] Japan ..... 52-66972

[51] Int. Cl.[2] ..... G07F 3/00

[52] U.S. Cl. ..... 133/3 R; 194/97 R; 194/100 A

[58] Field of Search ..... 194/97 R, 99, 100 R, 194/100 A, 101, 102, 1 K; 73/163; 133/3 R, 3 H

[56] References Cited

U.S. PATENT DOCUMENTS

| | | | |
|---|---|---|---|
| 3,916,922 | 11/1975 | Prümm | 133/3 R |
| 4,106,610 | 8/1978 | Heiman | 194/97 R |
| 4,108,296 | 8/1978 | Hayashi et al. | 194/99 |

*Primary Examiner*—F. J. Bartuska

*Attorney, Agent, or Firm*—Sughrue, Rothwell, Mion, Zinn and Macpeak

[57] ABSTRACT

The jamming or misdistributing of coins inserted into a coin sorting machine in quick succession is prevented by providing detectors upstream of the coin distributing member and returning the coins if a secondly inserted coin passes the first detector before the first coin passes the second detector.

2 Claims, 3 Drawing Figures

APPARATUS FOR CONTROLLING A COIN SORTING MACHINE

BACKGROUND OF THE INVENTION

1. Field of the Invention

This invention relates to a method and apparatus for controlling a coin sorting machine for use in vending machine, juke box etc., and more particularly to a method and apparatus for controlling a coin sorting machine operating to determine whether coins different in denomination moving in one and the same coin passageway are true coins or false coins, in which the successive insertion of coins at short time intervals is prevented and in which distribution of the sorted coins according to the denominations is positively carried out.

2. Description of the Prior Art

One type of the conventional coin sorting machine is mechanically operated. This conventional coin sorting machine has a number of movable components, and is limited in sorting accuracy and service life. For this reason, the present tendency is to use an electric type coin sorting machine which is superior to such mechanically operated coin sorting machines in sorting accuracy and service life.

In a known sorting means of such an electronic type coin sorting machine, a sorting coil operating as a detector is provided along the coin passage so as to form a bridge circuit with a reference coil to be compared with the sorting coil, and the balance point of the bridge circuit is detected when a coin passes through the sorting coil. In another known sorting means, an oscillation coil and a reception coil are provided to serve as a sorting coil, and a voltage induced in the reception coil is detected when the coin passes between these two coils. In another sorting means known in the art, an oscillator having a sorting coil as a resonance coil is provided, and the variation in oscillation frequency of the oscillator caused when a coin passes through the sorting coil is detected.

The machines of these types are so designed that coins of many denominations can be sorted out with only one sorting coil, in order to reduce the manufacturing cost. Accordingly, only one coin passageway is provided in the machine. Furthermore, the coins discharged out of the coin passageway are distributed in various directions in accordance with the detection results of the sorting means. More specifically, it is necessary to provide a segregating member for segregating the true coins and the false coins from each other and to provide another segregating member for segregating true coins in different directions separately according to the denominations. The former segregating member is provided in the coin passageway in such a manner as to selectively protrude into and retract from the coin passageway. When it is protruded into the coin passageway, the coin is not allowed to drop, and it is returned to the coin outlet. When it is retracted from the coin passageway, the coin is allowed to drop and is forwarded in the receiving direction. On the other hand, the latter segregating member is provided in the coin passageway in such a manner as to selectively protruded into and retract from the coin passageway, and the inserted coins are segregated separately according to their denominations into respective change-money tubes. In the system of controlling these segregating members merely according to the detection results of the sorting coil, a serious problem takes place when coins are inserted at very short time intervals.

It is assumed that the segregating member for segregating true coins from false coins is normally protruded into the coin passageway, and it is retracted from the coin passageway for a predetermined period of time for a true coin. For instance, in the case where coins successively inserted out of mischief are a true coin and a false coin, and the false coin is inserted after the true coin, while the segregating member for distributing the firstly inserted true coin is retracted from the coin passageway, the secondly inserted false coin will pass through that member. That is, in succession with the true coin, the false coin is forwarded in the receiving direction. If the diameter of the false coin is larger than that of the true coin, the false coin is jammed in the true coin passage, which makes the machine inoperable. On the other hand, if the diameter of the false coin is equal to or smaller than that of the true coin, the false coin will be put into the change-money tube.

In addition to the above, the system is disadvantageous in the following respect. In the case where successively inserted coins are true coins but they are different in denomination, the secondly inserted coin is segregated by the segregating member for segregating the firstly inserted coin, as a result of which the jamming of coins is caused similarly as in the above-described case, or coins of different denominations are put into the same change-money tube.

SUMMARY OF THE INVENTION

Accordingly, a primary object of this invention is to provide a method of controlling a coin sorting machine in which the above-described drawbacks accompanying a conventional coin sorting machine are eliminated by detecting the coins successively inserted at extremely short time intervals.

Briefly, this is accomplished by providing first and second detectors in the coin passage upstream of the coin segregating member and moving the segregating member to its coin return position when a second coin is detected by the first detector before the first coin has been detected by the second detector.

DETAILED DESCRIPTION OF THE PREFERRED EMBODIMENT

One embodiment of this invention will now be described in detail with reference to the accompanying drawings.

Figure 1:
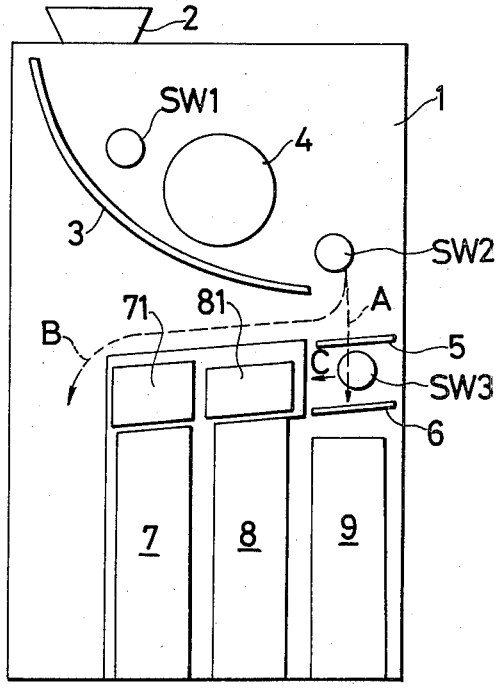
FIG. 1 is a front view showing essential components of one embodiment of a coin sorting machine according to this invention.

Referring to FIG. 1, reference numeral 1 designates a coin sorting machine; reference numeral 2, a coin inlet; reference numeral 3, a strip-shaped protruded piece forming a passageway along which a coin is rolled; reference numeral 4, a sorting coil; reference numerals 5 and 6, segregating members which are selectively protruded into and retracted from a coin passageway; reference numerals 7, 8 and 9, change-money tubes for accompanying 10-yen, 50-yen and 100-yen coins, respectively; reference numerals 71 and 81, coin sorting windows for 10-yen and 50-yen, respectively; reference characters SW1, SW2 and SW3, detectors for detecting the passage of coins; and reference characters A and B designate a receiving direction and a returning direction, respectively, in which coins segregated by the segregating member 5 are moved. Each of the detectors SW1, SW2 and SW3 comprises, for example, a light emitting diode or a photo-transistor.

A coin inserted into the coin inlet 2 is rolled along the protruded piece 3, and is passed through the first detector SW1, the sorting coil 4 and the second detector SW2 spaced from the first detector SW1 at a predetermined interval. In this case, if the coin is a true coin the segregating member 5 is retracted from the coin passageway thereby allowing the coin to drop, and if the coin is a false coin the segregating member 5 is protruded into the coin passageway thereby preventing the coin from dropping. Accordingly, the coin is moved in the receiving direction A or in the returning direction B depending on whether it is a true coin or a false coin.

When the coin moved in the direction A reaches the third detector SW3, it is distributed separately according to its monetary denomination by the segregating member 6. According to the present invention, coins successively inserted into the coin inlet are detected by the detectors SW1 and SW2, and if, before the firstly inserted coin reaches the second detector SW2, the secondly inserted coin reaches the first detector SW1, the segregating member 5 is protruded into the coin passageway whereby the coins moving at less than predetermined intervals cannot drop in the receiving direction and are returned because the segregating member 5 is protruded into the coin passageway. When a coin reaches the detector SW2, the segregating member 5 is controlled to protrude into the passageway or to retract from the passageway. As the detectors SW1 and SW2 are provided respectively upstream and downstream of the sorting coil 4 in the coin passageway, the detectors SW1 and SW2 can be utilized for determining a coin sorting period with the sorting coil 4. That is, in a coin sorting means for sorting out coins with a bridge circuit having the sorting coil 4 as its one side and a standard impedance as its other side, the bridge circuit is placed in a balanced state when a true coin passes through the sorting coil. Furthermore, the bridge circuit is balanced when a false coin which is made of the same material as that of a true coin but is larger in diameter than the true coin enters the region of and passes through the sorting coil 4. Accordingly, the provision of the detectors is advantageous in the case where, if the balance of the bridge circuit takes place only once during the coin sorting period, the coin is determined as a true coin.

The segregating member adapted to distribute true coins separately accordingly to their denominations is controlled when a coin reaches the detector SW3. For instance, in the case where 10-yen and 50-yen coins are inserted, the segregating member 6 is protruded into the coin passageway; and in the case where 100-yen coins are inserted, the segregating member 6 is retracted from the coin passageway. The 10-yen and 50-yen coins distributed by the segregating member 6 are moved on in the direction of the arrow C, and the 50-yen coins are dropped into the tube 8 through the sorting window 81, while the larger 10-yen coins are dropped into the tube 7 through the sorting window 71. On the other hand, the 100-yen coins distributed by the segregating member 6 are allowed to drop into the tube 9 because they are not blocked by the segregating member 6.

Now, the continuous insertion judgment and the control of the segregating members will be described with reference to FIGS. 2 and 3.

Figure 2:
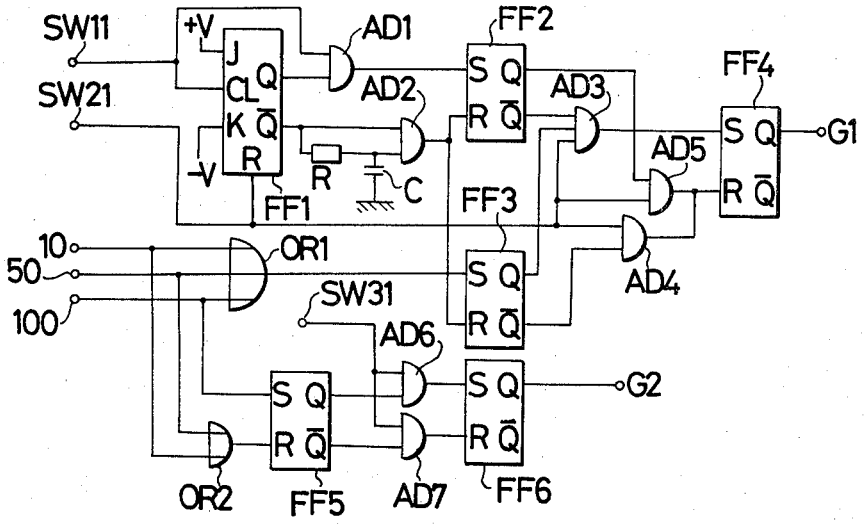
FIG. 2 is a block diagram for a circuit for judging the successive insertion of the coins.

Referring to FIG. 2, reference characters SW11, SW21 and SW31 designate input terminals receiving the detection signals of the detectors SW1, SW2 and SW3, respectively; reference numerals 10, 50 and 100, input terminals receiving 10-yen, 50-yen and 100-yen coin sorting signals, respectively; reference character FF1, a J-K type flip-flop and FF2 through FF6, R-S type flip-flops; reference characters $AD_1$ through $AD_7$, AND circuits; reference characters $OR_1$ and $OR_2$, OR circuits; reference character C, a capacitor; and reference characters $G_1$ and $G_2$, control signal output terminals through which control signals for controlling the segregating members 5 and 6 are provided, respectively.

When a coin inserted into the coin inlet is detected by the detector SW1, the latter outputs a detection signal, which is applied through the terminal SW11 to the flip-flop FF1 to set the latter. When, before the coin is detected by the detector SW2 to reset the flip-flop FF1, a detection signal representative of the insertion of the next coin is provided through the terminal SW11, the flip-flop FF2 is set, thereby indicating that coins are continuously inserted. In other words, when, before a firstly inserted coin reaches the detector SW2 through the detector SW1, a secondly inserted coin reaches the detector SW1, the flip-flop FF2 is set. When the coin detection signal of the detector SW2 is applied through the terminal 21 to the reset terminal R of the flip-flop FF1, the flip-flop FF1 is reset, as a result of which the flip-flops FF2 and FF3 are reset with a very short time delay caused by the capacitor C connected to the terminal $\overline{Q}$ of the flip-flop FF1.

The flip-flop FF3 is set when a sorting signal representative of a true coin is applied through the terminal 10, 50 or 100 to the flip-flop FF3 by a sorting means (not shown) having the sorting coil 4. If the flip-flop FF3 is set during the coin sorting period which elapses from the time constant that application of the reset input signal to the flip-flop FF3 is released upon application of the detection signal to the flip-flop FF1 through the terminal SW11 until the flip-flop FF1 is reset by an input signal applied through the terminal SW21, then the flip-flop FF3 stores the true-coin insertion.

When the detection signal is applied through the terminal SW21 under the conditions that the flip-flop FF2 has been reset and the flip-flop FF3 has been set, the flip-flop FF4 is set. This is the case where inserted coins are spaced more than a predetermined distance from each other and the coins are true coins. When the detection signal is applied through the terminal SW21 under the conditions that the flip-flop FF2 has been set or the flip-flop FF3 has been reset, the flip-flop FF4 is reset. That is, the flip-flop FF4 is reset when inserted coins are spaced less than the predetermined distance from each other, or when inserted coins are false coins.

The control signal applied to the segregating member 5 through the terminal $G_1$ causes the segregating member 5 to retract from the coin passageway when the flip-flop FF4 is set, and to protrude into the coin passageway when the flip-flop FF4 is reset.

Upon application of the detection signal through the terminal 100, the flip-flop FF5 is set. The flip-flop FF5 is reset by the detection signal applied thereto through one of the terminals 10 and 50 and the OR circuit $OR_2$.

The flip-flop FF6 is set when the detection signal is applied through the terminal SW31 under the condition that the flip-flop FF5 has been set. The flip-flop FF6 is reset when, under the condition that the flip-flop FF5 has been reset, the AND condition of the AND circuit $AD_7$ is satisfied upon application of the detection signal through the terminal SW31.

In other words, the flip-flop FF5 is set upon application of the sorting signal through the terminal 100, and when the detector SW3 detects the coin with the flip-flop FF5 being set, the flip-flop FF6 is set. As a result, the control signal is applied to the segregating member 6 through the terminal $G_2$ from the terminal Q of the flip-flop FF6, to thereby cause the segregating member 6 to retract from the passageway. When the sorting signal is applied through one of the terminals 10 and 50, a reset input signal is applied to the reset terminal R of the flip-flop FF5 to reset the latter.

The flip-flop FF6 is reset when a 10-yen coin or a 50-yen coin is detected by the detector SW3 after the flip-flop FF5 has been reset. If, in this case, the segregating member 6 has been retracted from the coin passageway, it is caused to protrude into the passageway. Thus, when a 100-yen coin is inserted, it is dropped into the tube 9 without being blocked by the segregating member 6. On the other hand, when a 10-yen coin or a 50-yen coin is inserted, it is moved in the direction of the arrow C by the segregating member 6 preventing the coin from dropping toward the tube 9, and is distributed into the sorting window 71 or 81 depending on its diameter.

The operation of the coin sorting machine according to the invention will now be described with reference to FIG. 3, in which the columns (a) through (f) correspond to different states.

First, the case where inserted coins are spaced more than the predetermined distance from each other and they are true 100-yen coins, will be described. The waveforms in this case are as indicated in the column (a) of FIG. 3. When the coin is detected by the detector SW1, a logical signal "1" (hereinafter referred to merely as a signal "1", or "1", when applicable) is applied through the terminal SW11 to the flip-flop FF1, as a result of which a logical signal "0" (hereinafter referred to merely as a signal "0", or "0", when applicable) is provided at the terminal $\overline{Q}$ of the flip-flop FF1. Therefore, the output of the AND circuit $AD_2$ is raised to the "0" level and, therefore, application of the reset input signal to the flip-flops FF2 and FF3 is released. When the coin reaches the sorting coil 4, a coin sorting signal indicated by C in FIG. 3 is provided at the terminal 100. When this coin sorting signal is applied through the OR circuit $OR_1$ to the flip-flop FF3, the latter is set. Thereafter, when the inserted coin is detected by the detector SW2, the detection signal is applied through the terminal SW21 to the flip-flop FF1 to reset the latter. In this operation, the signal "1" is applied through the terminal SW21 to the AND circuit $AD_3$ and, therefore, with this signal "1" the output "1" at the terminal $\overline{Q}$ of the flip-flop FF2 and the output "1" at the terminal $\overline{Q}$ of the flip-flop FF3, the AND condition of the AND circuit $AD_3$ is satisfied. As a result, the flip-flop FF4 is set.

As soon as the flip-flop FF4 is set, the signal "1" is outputted through the terminal $G_1$, so that the segregating member 5 shown in FIG. 1 is retracted from the coin passage way to lead the coin in the receiving direction.

When the flip-flop FF1 is reset by the detection signal applied through the terminal SW21 as described above, the signal "1" is outputted through the terminal $\overline{Q}$ thereof, and the AND condition of the AND circuit $AD_2$ is satisfied a little later than the provision of the detection signal of the detector SW2. As a result, the reset signal is applied to the flip-flops FF2 and FF3, and the flip-flop FF3 is reset.

As the flip-flop FF3 is reset, the signal "1" is applied to one input terminal of the AND circuit $AD_4$; however, in this case the output of the AND circuit $AD_4$ is at "0" because no detection signal is applied through the terminal SW21.

On the other hand, upon application of the sorting signal to the terminal 100, the flip-flop FF5 is set, so that the signal "1" is applied through its terminal Q to one input terminal of the AND circuit $AD_6$. When the inserted coin reaches the detector SW3 passing through the gate 5, the detection signal is outputted by the detector SW3.

This detection signal is applied through the terminal SW31 to the other input terminal of the AND circuit $AD_6$, whereby the AND condition of the AND circuit $AD_6$ is satisfied to apply the set input signal to the flip-flop FF6.

As a result, the gate signal "1" is delivered through the control terminal $G_2$ to the segregating member, to thereby cause the segregating member 6 to retract from the coin passageway. Therefore, the coin is dropped into the tube 9 without being blocked by the gate 6.

Now, the case where successive insertion of the coins are not effected, but the inserted coins are false coins, will be described. The waveforms in this case are shown in the column (b) of FIG. 3.

Figure 3:
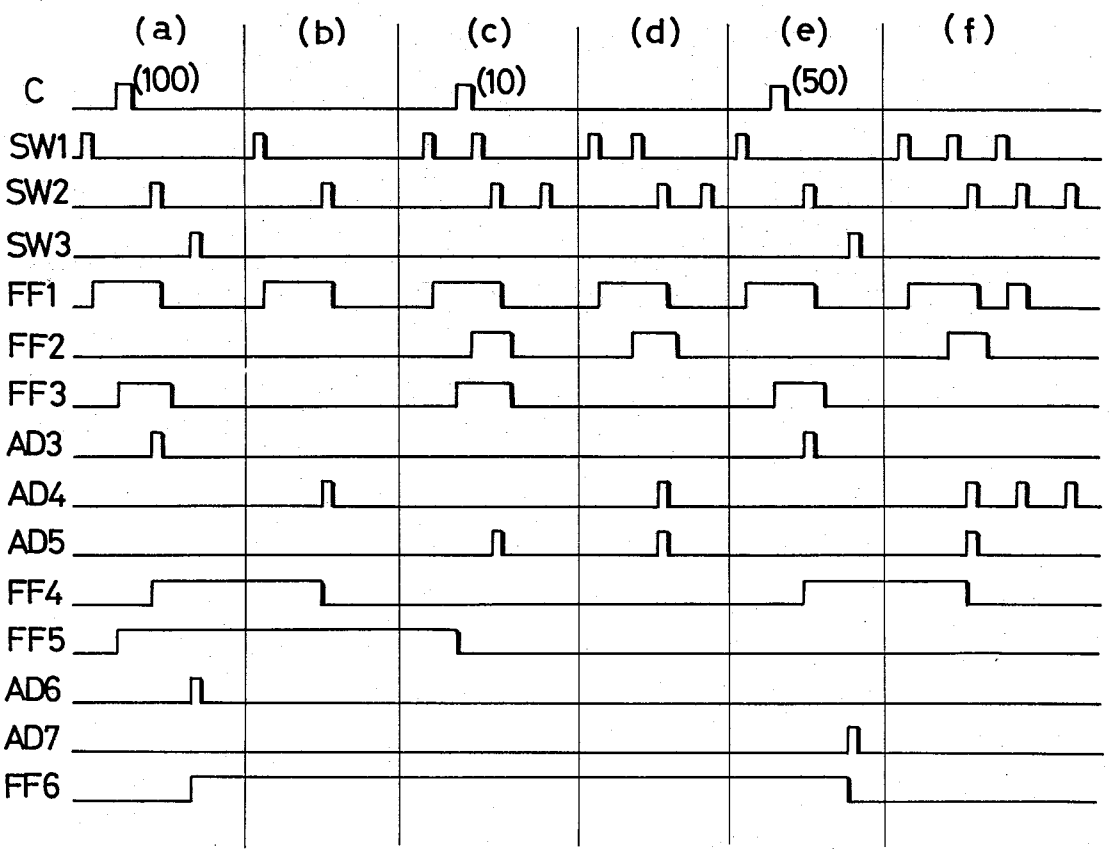
FIG. 3 shows output waveforms of the block diagram shown in FIG. 2.

As indicated in the column (b) of FIG. 3, the coin is first detected by the detector SW1, as a result of which the flip-flop FF1 is set.

Thereafter, the coin reaches the position of the sorting coil 4. Since the coin is a false coin, no set input signal is applied to the flip-flop FF3 through the terminal 10, 50 or 100 and through the OR circuit $OR_1$ and, therefore, the flip-flop FF3 is maintained reset. Thereafter, the coin is detected by the detector SW2. In this case, the flip-flop FF1 is reset, while the AND condition of the AND circuit $AD_4$ receiving the detection signal of the detector SW2 is satisfied because the flip-flop FF3 is in reset state. Accordingly, the reset signal is applied from the AND circuit $AD_4$ to the flip-flop FF4 to reset the latter. As a result, the signal is delivered out through the control terminal $G_1$. The gate 5 which has been retracted from the passageway by the previous sorting operation is protruded into the passageway, as a result of which dropping the coin in the receiving direction is prevented, that is, the coin is sent in the returning direction. On the other hand, the gate 6 is maintained retracted from the passageway, because no sorting signal is applied through the terminals 10 or 50 and the flip-flops FF5 and FF6 are maintained set.

Described below is the case where coins are successively inserted into the coin inlet, they are spaced less than the predetermined distance from each other, and the firstly inserted coin is a true coin (10-yen) and the secondly inserted coin is a false coin. The waveforms in this case are shown in the column (c) of FIG. 3.

When the firstly inserted coin is detected by the detector SW1, the flip-flop FF1 is set by the detection signal of the detector SW1, and application of the reset input signal to the flip-flops FF2 and FF3 is released.

When the coin reaches the position of the sorting coil 4, the set input signal is applied through the terminal 10 and the OR circuit $OR_1$ to the flip-flop FF3, while the reset input signal is applied through the terminal 10 and the OR circuit $OR_2$ to the flip-flop FF5. Before the firstly inserted coin (hereinafter referred to as the first coin, when applicable) reaches the detector SW2, the secondly inserted coin (hereinafter referred to as the second coin, when applicable) reaches the detector SW1. As a result, the signal "1" is applied through the terminal SW11 to one input terminal of the AND circuit $AD_1$. In this case, since the signal "1" at the terminal Q of the flip-flop FF1 has been applied to the other input terminal of the AND circuit $AD_1$, the AND condition thereof is satisfied. As a result, the flip-flop FF2 is set, thus sorting that the coins are spaced less than the predetermined distance from each other. When the first coin reaches the detector SW2 and is detected by the detector SW2, the signal "1" is applied through the terminal SW21 to one input terminal of the AND circuit $AD_5$. In this case, as the flip-flop FF2 has been set, the AND condition of the AND circuit $AD_5$ is satisfied and, therefore, the reset signal is applied to the flip-flop FF4. In this operation, as the flip-flop FF4 has been reset by the previous coin sorting operation, the flip-flop FF4 is maintained reset, and the segregating member 5 is maintained protruded into the passageway.

When the flip-flop FF2 is set to satisfy the AND condition of the AND circuit $AD_5$, the set state of the flip-flop FF4 is changed to the reset state, as a result of which the gate 5 which has been retracted from the passageway is caused to protrude into the passageway. Upon application of the detection signal through the terminal SW21, the flip-flop FF1 is reset, as a result of which the flip-flops FF2 and FF3 are reset to place the machine in a standby state.

On the other hand, the flip-flop FF5 is in a reset state because the sorting signal is applied thereto through the terminal 10 as was described above, but the flip-flop FF6 is still maintained reset. As the gate 5 is protruded into the passageway as was described before, the continuously inserted coins are distributed in the returning direction B.

Now, the case where successively inserted coins are spaced less than the predetermined distance from each other, and they are false coins, will be described. The waveforms in this case are indicated in the column (d) of FIG. 3.

When the firstly inserted coin is detected by the detector SW1, the flip-flop FF1 is set and, therefore, application of the reset input signal to the flip-flops FF2 and FF3 is released.

Before this coin reaches the detector SW2, the secondly inserted coin is detected by the detector SW1. Therefore, the flip-flop FF2 is set by the detection signal applied through the AND circuit $AD_1$, thus sorting the successive coin insertion. Even if the firstly inserted coin passes through the sorting coil 4, no sorting signal is inputted through the terminal 10, 50 or 100 because it is a false coin. When this firstly inserted coin is detected by the detector SW2, the reset signal is applied to the flip-flop FF4 through the AND gate $AD_5$. In this case, as the flip-flop FF4 has been reset since the previous operation, the reset state thereof is maintained, and the segregating member 5 maintained protruded into the passageway. When the detection signal is applied through the terminal SW21 to the flip-flop FF1 as was described before, the flip-flop FF1 is reset and the reset signal is applied to the flip-flops FF2 and FF3, as a result of which the machine is placed in the standby state.

The case where inserted coins are true coins (50-yen) and only coins of this denomination are inserted into the machine, will be described. The waveforms in this case are indicated in the column (e) of FIG. 3.

When the coin is inserted into the coin inlet is detected by the detector SW1, the flip-flop FF1 is set, and application of the reset input signal to the flip-flops FF2 and FF3 is released.

When the coin reaches the sorting coil 4 through the detector SW1, the sorting signal is applied to the terminal 50. The sorting signal is applied, as a reset signal, through the OR circuit $OR_2$ to the flip-flop FF5. In this case, as the flip-flop FF5 has been reset before, the reset state of the flip-flop FF5 is maintained. Thereafter, when the coin is detected by the detector SW2, the AND condition of the AND circuit $AD_3$ receiving the detection signal of the detector SW2 as its one input signal is satisfied because the flip-flop FF2 is in a reset state and the flip-flop FF3 has been set, as a result of which the set input signal is applied to the flip-flop FF4 by the AND gate $AD_3$. Thus, the flip-flop FF4 is set to deliver the signal "1" to the gate through the gate terminal $G_1$ to the segregating member 5, as a result of which the segregating member 5 is extracted from the coin passageway. As was described before, upon application of the detection signal through the terminal SW21, the flip-flop FF1 is reset and, therefore, the reset signal is continuously applied to the flip-flops FF2 and FF3. Thus, the standby state is established.

The coin passed through the detector SW2 is led in the receiving direction A without being blocked by the segregating member 5 and is detected by the switch SW3. When the coin is detected by the switch SW3, the AND condition of the AND circuit $AD_7$ is satisfied as the flip-flop FF5 has been reset and, therefore, the reset input signal is applied to the flip-flop FF6 by the AND circuit $AD_7$. When the flip-flop FF6 is reset, the signal "0" is provided at its terminal Q, as a result of which the gate 6 is protruded into the passageway. Thus, dropping of the coin is blocked by the segregating member 6, that is, the coin is delivered in the direction of the arrow C and is put into the container 8 through the sorting window 81.

Described below is the case where three coins are successively inserted into the coin inlet, and moved along the passageway, but the distances between the firstly inserted coin and the secondly inserted coin and also the distance between the secondly inserted coin and the thirdly inserted coin are less than the predetermined value. The waveforms in this case are indicated in the column (f) of FIG. 3.

The flip-flops FF1 and FF2 are set by the firstly and secondly inserted coins. Thereafter, when the firstly inserted coin reaches the detector SW2, the reset input signal is applied through the AND circuit $AD_5$ to the flip-flop FF4. As a result, the gate 6 is protruded into the coin passageway to return the coins. Before the secondly inserted coin reaches the detector SW2, the flip-flop FF1 is set again by the thirdly inserted coin; however, it is reset when the secondly inserted coin reaches the detector SW2. Thus, the reset state of the flip-flop FF4 is maintained unchanged, and the segregating member 6 is maintained protruded into the passageway to return the coins.

Thus, according to the invention, in the case when inserted coins are spaced less than the predetermined distance from each other, the coins are positively returned. Therefore, the coin sorting machine according to the invention does not suffer from the drawbacks that a false coin is led in the receiving direction after a true coin to thereby cause the jamming of coins, or resulting in a false coin together with a true coin being put into the same container.

The control of the gates in the case where a false coin and a true coin are inserted, and in the case where true coins are distributed separately according to their denominations is carried out while the position of the coin rolling along the coin passageway is detected. Therefore, distribution of coins is accomplished correctly. Furthermore, the states of the gates protruding into and retracting from the passageway are not switched for every coin sorting operation; that is, the gates are selectively protruded into and retracted from the passageway as required. Therefore, the fatigue of, for instance, an electromagnet operating to cause the gate to protrude into or retract from the passageway can be reduced.

What is claimed is:

1. A coin sorting machine of the type having a sorting means in a coin passageway for discriminating between true and false inserted coins and for providing corresponding true and false coin sorting signals, and a controllable segregating member for segregating a coin in a true coin direction or a false coin direction in response to said true and false sorting signals, respectively, the improvement comprising:

first coin detector means upstream of said segregating member for providing a first coin detection signal indicating the passage of a coin;

second coin detector means upstream of said segregating member and downstream of said first detector for providing a second coin detection signal indicative of the passage of a coin; and logic circuit means for receiving said first and second detection signals and controlling said segregating member to segregate coins in a false coin direction when two first detection signals are received in succession without an intervening second coin detection signal;

said logic circuit means comprising:

first flip-flop means switched to a set condition by said first coin detection signal to provide a first set signal, and switched to a reset condition by said second coin detection signal to provide a first reset signal;

first AND circuit means responsive to the simultaneous appearance of said first set signal and a following first coin detection signal to produce a first AND signal;

second flip-flop means switched to a set condition by said first AND signal to produce a second set signal, and switched to a reset condition by said second coin detection signal to produce a second reset signal;

third flip-flop means switched to a set condition by a true coin sorting signal to produce a third set signal, and switched to a reset condition by said first reset signal to produce a third reset signal;

second AND circuit means responsive to the simultaneous occurrence of said second reset signal, said third set signal and said second coin detection signal to produce a second AND signal;

fourth flip-flop means switched to a set condition by said second AND signal to produce a control signal indicative of the detection of an inserted true coin spaced at least a predetermined minimum time from a following inserted coin, said segregating member being controlled by said control signal to segregate the true coin in said true coin direction;

third AND circuit means responsive to the simultaneous occurrence of said second set signal and said second coin detecting signal to produce a third AND signal;

said fourth flip-flop means being switched to a reset condition by said third AND signal thereby to inhibit the production of said control signal so that said true coin is segregated in said false coin direction when the time between two successively inserted coins is less than said predetermined time; and fourth AND circuit means responsive to said third reset signal and said second coin detection signal to provide a fourth AND signal;

said fourth flip-flop means being switched to the reset condition by said fourth AND signal thereby also to inhibit the production of said control signal so that said segregating member segregates a false coin in said false coin direction.

2. A coin sorting machine according to claim 1, wherein said true sorting signal identifies the denomination of a coin, said machine further comprising:

a third coin detector downstream of said segregating member in said true coin direction and providing a third detection signal indicative of the passage of a coin; and a distribution member for distributing coins according to their denominations in response to said sorting signal and said third detection signal.

* * * * *